US011491794B2

(12) United States Patent
Takabayashi et al.

(10) Patent No.: US 11,491,794 B2
(45) Date of Patent: Nov. 8, 2022

(54) RECORDING APPARATUS

(71) Applicant: SEIKO EPSON CORPORATION, Tokyo (JP)

(72) Inventors: Kazunori Takabayashi, Okaya (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 17/195,222

(22) Filed: Mar. 8, 2021

(65) Prior Publication Data

US 2021/0283918 A1 Sep. 16, 2021

(30) Foreign Application Priority Data

Mar. 11, 2020 (JP) ..... JP2020-041595

(51) Int. Cl.
*B41J 2/17* (2006.01)
*B41J 2/175* (2006.01)

(52) U.S. Cl.
CPC ..... *B41J 2/1721* (2013.01); *B41J 2/175* (2013.01)

(58) Field of Classification Search
CPC ..... B41J 2/1721; B41J 2/175
See application file for complete search history.

(56) References Cited

U.S. PATENT DOCUMENTS

| | | | | |
|---|---|---|---|---|
| 2005/0151782 | A1 | 7/2005 | Ishida et al. | |
| 2019/0263126 | A1* | 8/2019 | Tanaka | B41J 2/185 |
| 2020/0290380 | A1 | 9/2020 | Miyagawa et al. | |
| 2020/0290381 | A1 | 9/2020 | Yoda et al. | |

FOREIGN PATENT DOCUMENTS

| | | |
|---|---|---|
| JP | 2006-035662 | 2/2006 |
| JP | 2020-146920 | 9/2020 |
| JP | 2020-146921 | 9/2020 |

* cited by examiner

*Primary Examiner* — Justin Seo
(74) *Attorney, Agent, or Firm* — Workman Nydegger

(57) ABSTRACT

A recording apparatus includes an apparatus main body including: a transport unit that transports a medium; a liquid ejecting head that is provided above a transport path for the medium and performs recording by ejecting liquid onto the medium; and an accommodating unit that accommodates a waste liquid container configured to store waste liquid discharged from the liquid ejecting head, wherein a front surface of the apparatus main body is provided with a front wall and an operable operation unit, which are adjacent to each other in a width direction, and the accommodating unit is located between the front wall and the liquid ejecting head in a depth direction at a position that does not overlap the operation unit in the width direction.

6 Claims, 5 Drawing Sheets

RECORDING APPARATUS

The present application is based on, and claims priority from JP Application Serial Number 2020-041595, filed Mar. 11, 2020, the disclosure of which is hereby incorporated by reference herein in its entirety.

BACKGROUND

1. Technical Field

The present disclosure relates to printers such as recording apparatuses.

2. Related Art

There have been recording apparatuses that perform printing by ejecting ink, which is an example of a liquid, from an ink jet head, which is an example of a liquid ejecting head. JP-A-2006-35662 discloses an example of such a recording apparatus. The recording apparatus includes an operation panel, a cartridge holder that holds an ink cartridge, and a waste liquid absorbing member as an example of a waste liquid container that absorbs waste liquid generated in maintenance. Since the operation panel and the cartridge holder are provided at front positions in the recording apparatus, the operator can easily perform operation. On the other hand, the waste liquid absorbing member is accommodated in a rear space in the recording apparatus.

The waste liquid container provided at a rear position in the recording apparatus is difficult to access for maintenance. However, the operation panel is provided at a front position in the recording apparatus. If the waste liquid container is arranged side by side with the operation panel in the depth direction at a front position in the recording apparatus, the recording apparatus increases in size in the depth direction.

SUMMARY

A recording apparatus for solving the above problem includes an apparatus main body including: a transport unit that transports a medium; a liquid ejecting head that is provided above a transport path for the medium and performs recording by ejecting liquid onto the medium; and an accommodating unit that accommodates a waste liquid container configured to store waste liquid discharged from the liquid ejecting head, wherein a front surface of the apparatus main body is provided with a front wall and an operation panel that can be operate various operations, which are adjacent to each other in a width direction, and the accommodating unit is located between the front wall and the liquid ejecting head in a depth direction at a position that does not overlap the operation panel in the width direction.

DESCRIPTION OF EXEMPLARY EMBODIMENTS

With reference to the drawings, an embodiment of a recording apparatus will be described below. A recording apparatus is, for example, an ink jet printer that performs printing by ejecting ink, which is an example of liquid, onto a medium such as a paper sheet.

Throughout the drawings, the X and Y axes indicate directions extending parallel to a horizontal plane, and the Z axis indicates the direction of gravity. A recording apparatus 11 is illustrated as being placed on the horizontal plane. The X, Y, and Z axes are orthogonal to each other. In the following description, a direction parallel to the X axis may also be referred to as a width direction X, a direction parallel to the Y axis may also be referred to as a depth direction Y, and a direction parallel to the Y and Z axes may also be referred to as a vertical direction Z.

Figure 1:
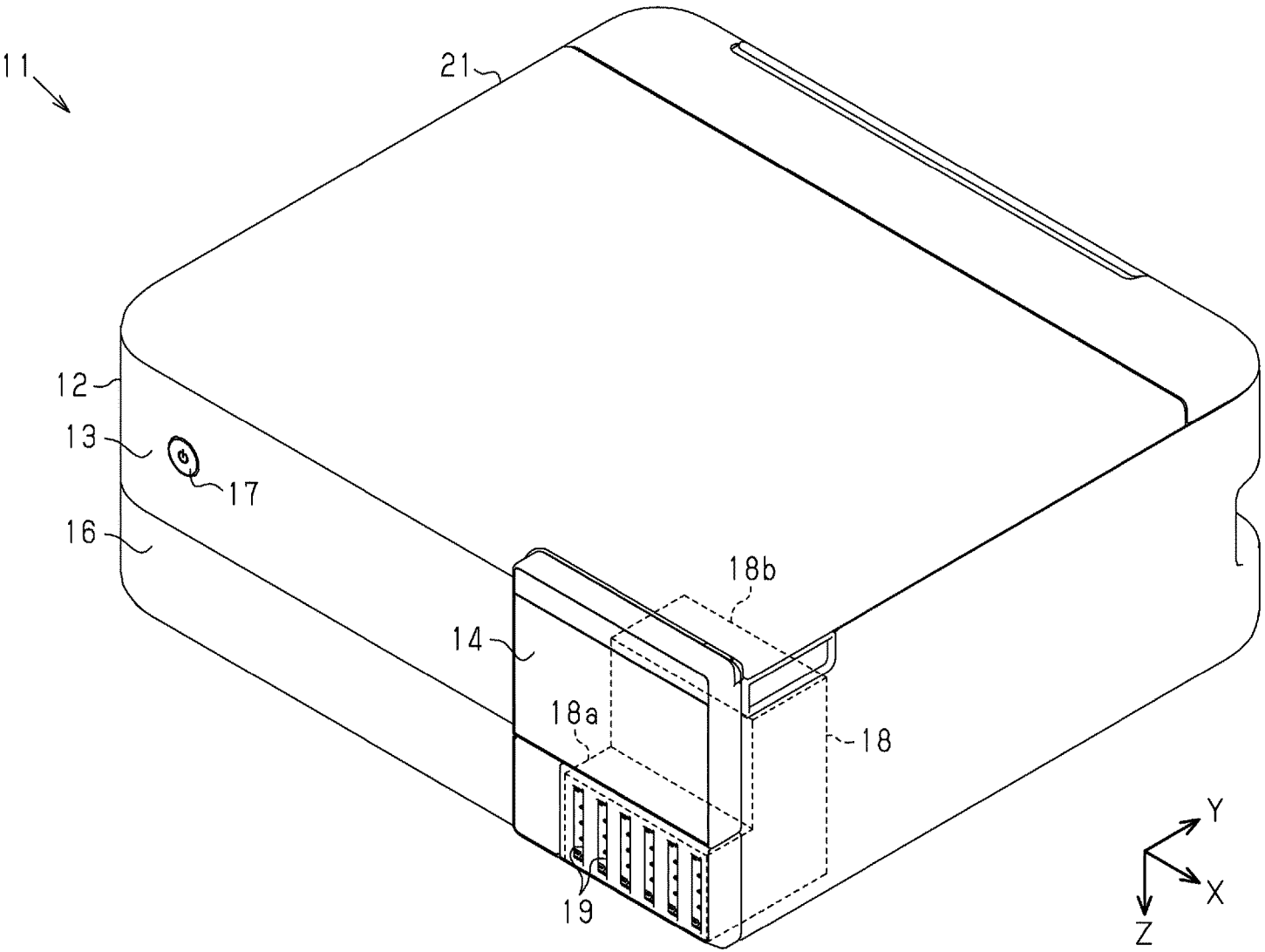
FIG. 1 is a perspective view of an embodiment of a recording apparatus.

As shown in FIG. 1, the recording apparatus 11 includes an apparatus main body 12, a front wall 13 provided on a front surface of the apparatus main body 12, and an operation panel 14 also provided on the front surface of the apparatus main body 12 and operable on the front side of the apparatus main body 12. The front wall 13 and the operation panel 14 are adjacent to each other in the width direction X. For example, the operation panel 14 is a touch panel for performing various operations for the recording apparatus 11. The operation panel 14 may further include a display unit that displays information on the recording apparatus 11, and operable buttons.

The recording apparatus 11 may further include a front cover 16 that openably covers the front surface of the apparatus main body 12, a power button 17 provided on the front wall 13, and a window 19 provided under the operation panel 14 so that a liquid container 18 is partially exposed therethrough. The window 19 allows the liquid stored in the liquid container 18 to be seen through the front surface of the apparatus main body 12. The recording apparatus 11 may further include a plurality of liquid containers 18 and a plurality of windows 19. The liquid container 18 may further include a front container 18*a*, which is a front portion and partially exposed through the window 19, and a rear container 18*b*, which is a rear portion located on a rear side of the front container 18*a* and has a dimension in the vertical direction Z larger than that of the front container 18*a*.

Figure 2:
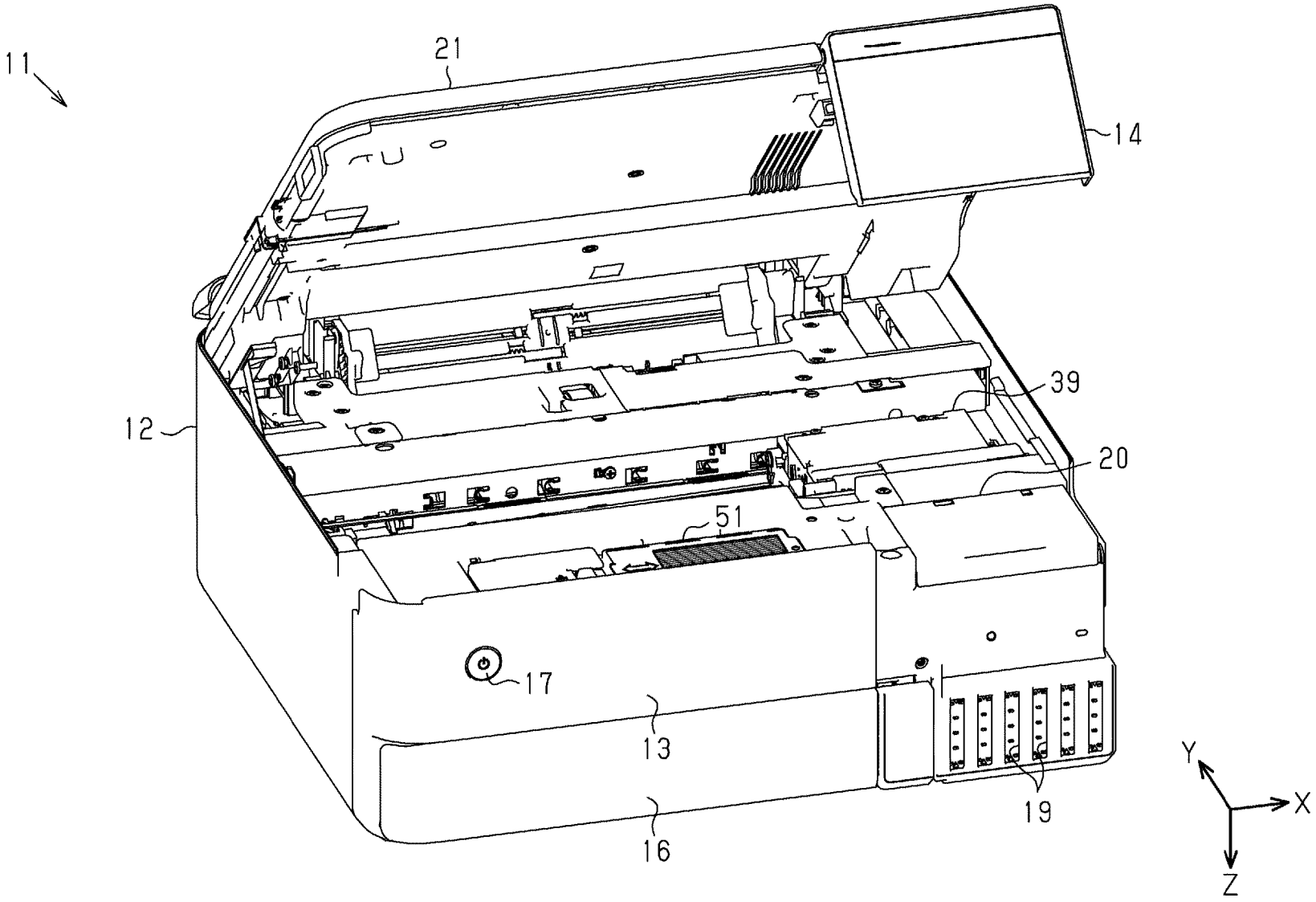
FIG. 2 is a perspective view of the recording apparatus in which an image reading unit and an operation panel are at an open position.

As shown in FIG. 2, the recording apparatus 11 may further include an inner lid 20 provided above the liquid container 18, and an image reading unit 21 that reads an image of a document (not shown). The image reading unit 21 may be provided on the apparatus main body 12 and openably cover the top of the apparatus main body 12. The operation panel 14 of the present embodiment is joined to the image reading unit 21 and moves together with the image reading unit 21. Specifically, the image reading unit 21 and the operation panel 14 are movable between a closed position shown in FIG. 1 and an open position shown in FIG. 2.

When at the closed position, the image reading unit 21 and the operation panel 14 can be rotated about a shaft (not shown) provided parallel to the X axis on a rear side of the image reading unit 21 to thereby move to the open position. The image reading unit 21 located at the closed position closes the top of the apparatus main body 12. The image reading unit 21 located at the open position allows the inside of the apparatus main body 12 to be exposed through the top.

When the image reading unit 21 is located at the open position, the inner lid 20 becomes movable from a closed position shown in FIG. 2 to an open position (not shown). The inner lid 20 located at the closed position covers the upper part of the liquid container 18. The inner lid 20 located at the open position allows the entirety or part of the liquid container 18 to be accessed from above. With this configuration, the liquid container 18 can be replaced, or liquid in the container 18 can be replenished.

As shown in FIG. 1, the operation panel 14 located at the closed position, the window 19, and the front container 18*a* are arrayed in the vertical direction Z. That is, the operation panel 14 at the closed position is located above the window 19 and the front container 18*a*. The operation panel 14 at the closed position overlaps the front container 18*a* in the width direction X and the depth direction Y, and does not overlap the front container 18*a* in the vertical direction Z. The operation panel 14 located at the closed position and the rear container 18*b* are arrayed in the depth direction Y. That is, the operation panel 14 at the closed position is located in front of the rear container 18*b*, and overlaps the rear container 18*b* in the width direction X and the vertical direction Z, and does not overlap the rear container 18*b* in the depth direction Y.

Figure 3:
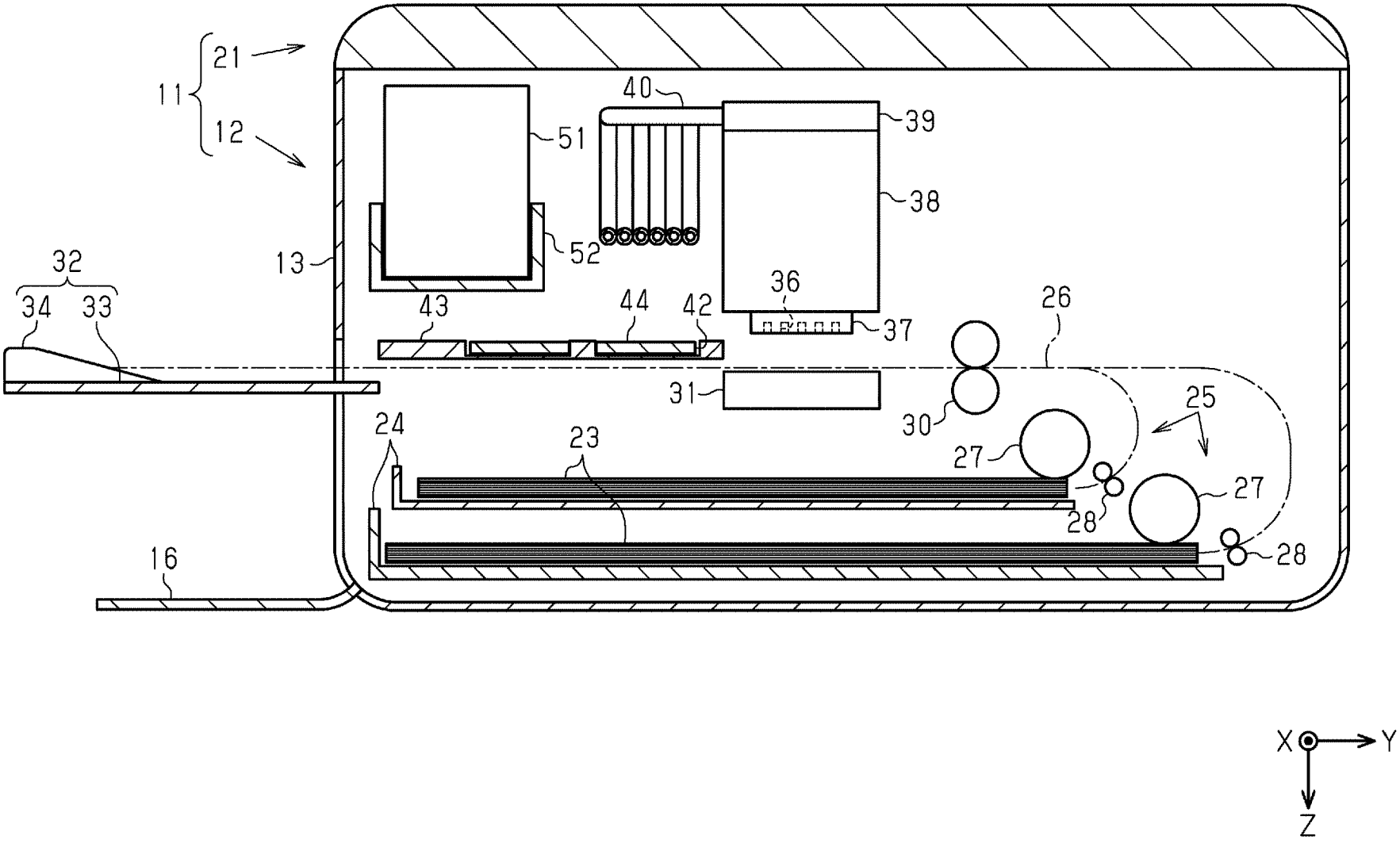
FIG. 3 is a schematic side cross-sectional view illustrating an internal configuration of the recording apparatus.

As shown in FIG. 3, the recording apparatus 11 may further include a medium storage unit 24 configured to store a stack of a plurality of media 23, and a feeding unit 25 that feeds the media 23 from the medium storage unit 24. The feeding unit 25 may further include a feed roller 27 that feeds out the media 23 to a transport path 26, which is indicated by the dot and dashed line in FIG. 3, and a separation unit 28 that separates the media 23 one by one. The recording apparatus 11 may further include a plurality of medium storage units 24 and a plurality of feeding units 25. The recording apparatus 11 of the present embodiment includes two medium storage units 24 arranged side by side in the vertical direction Z, and two feeding units 25.

The recording apparatus 11 includes a transport unit 30 that transports the medium 23. The recording apparatus 11 may further include a support unit 31 that supports the medium 23 transported along the transport path 26, and an output tray 32 that supports the medium 23 outputted from the apparatus main body 12. As the medium 23 is fed out by the feeding unit 25, the transport unit 30 transports the medium 23 along the transport path 26. The transport unit 30 transports the medium 23 from the medium storage unit 24 located upstream in the transport direction to the output tray 32 located downstream in the transport direction. The transport direction is a direction extending along the transport path 26.

The output tray 32 includes a support surface 33 that supports the medium 23, and a projection 34 that protrudes upward from the support surface 33 to support the medium 23. The output tray 32 may include a plurality of projections 34. The output tray 32 of the present embodiment includes two projections 34 spaced from each other in the width direction X. That is, in the output tray 32, a center portion of the medium 23 in the width direction X is supported by the support surface 33, while both ends of the medium 23 in the width direction X are supported by the projections 34. In the output tray 32, the medium 23 is curved so that both ends of the medium 23 in the width direction X are supported at positions higher than the center portion of the medium 23.

The recording apparatus 11 includes a liquid ejecting head 37 that performs recording by ejecting liquid from nozzles 36 onto the medium 23. The liquid ejecting head 37 is provided above the support unit 31. A top of the support unit 31 constitutes part of the transport path 26. For this reason, the liquid ejecting head 37 is provided above the transport path 26 for the medium 23. The liquid ejecting head 37 may be mounted on a carriage 38 that is movable in the width direction X. As the carriage 38 moves, the liquid ejecting head 37 reciprocates in the X axis direction above the support unit 31. The recording apparatus 11 may further include a liquid relay unit 39 provided on the carriage 38, and a tube 40 that communicates the liquid relay unit 39 with the liquid container 18.

The recording apparatus 11 may further include a disk tray 43 above the transport path 26 to support a disk 42 that stores information. The liquid ejecting head 37 can perform recording onto a label surface 44 of the disk 42 supported by the disk tray 43 by ejecting liquid onto the label surface 44. The disk tray 43 is configured to reciprocate in the Y axis direction. When the liquid ejecting head 37 performs recording onto the disk 42, the disk tray 43 moves to a position between the liquid ejecting head 37 and the support unit 31 so that the label surface 44 faces the liquid ejecting head 37. When the liquid ejecting head 37 performs printing onto the medium 23, the disk tray 43 is retracted from a position under the liquid ejecting head 37 so that the medium 23 supported by the support unit 31 faces the liquid ejecting head 37.

The medium storage unit 24, the output tray 32, and the disk tray 43 are accommodated behind the front cover 16 located at the closed position as shown in FIG. 1, and can be pulled out forward when the front cover 16 is located at the open position as shown in FIG. 3.

Figure 4:
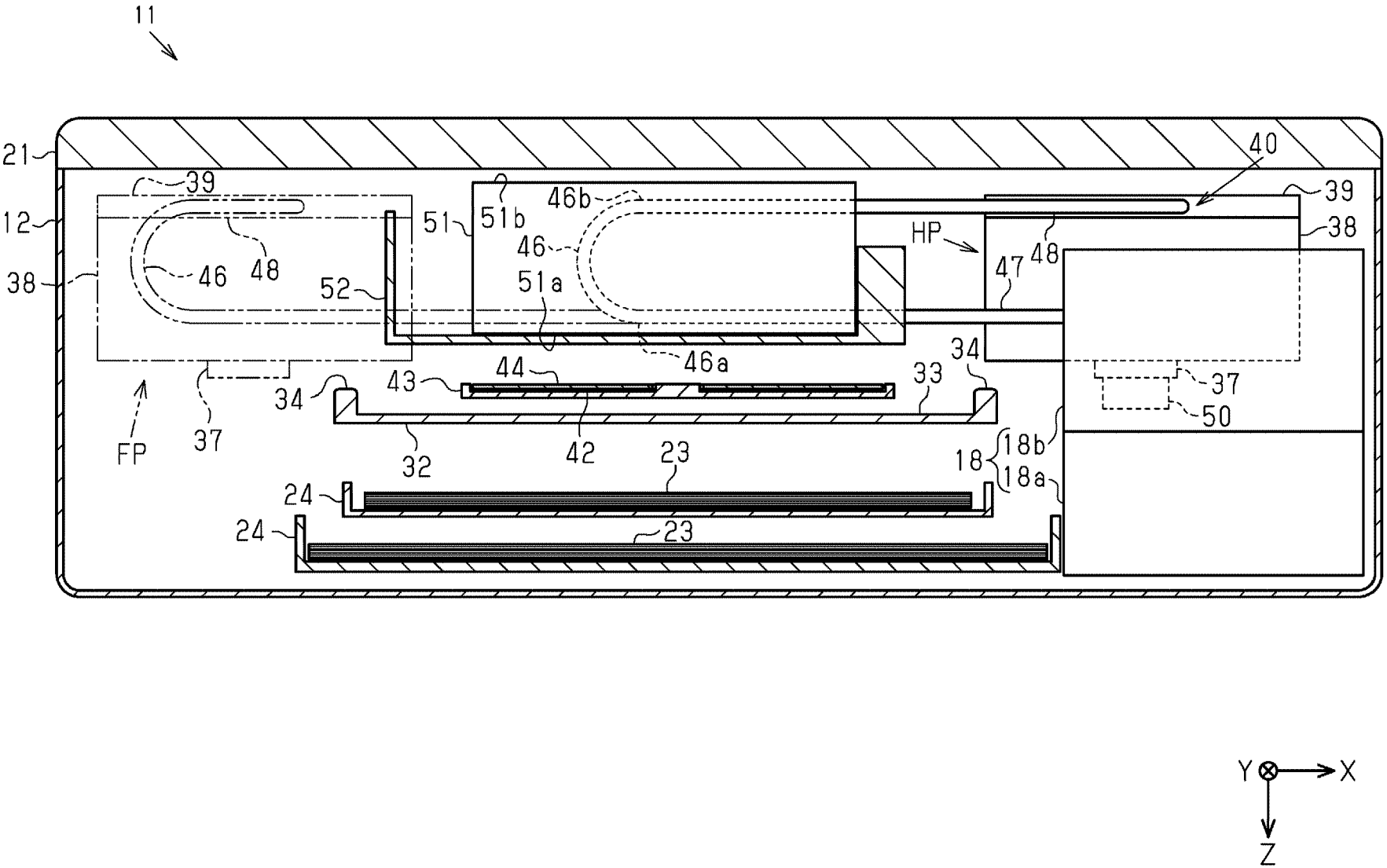
FIG. 4 is a schematic front cross-sectional view illustrating an internal configuration of the recording apparatus.

As shown in FIG. 4, the liquid container 18 is located in front of the liquid ejecting head 37 and the carriage 38 located at a home position HP indicated by the solid line in FIG. 4. The position of the rear container 18*b* of the liquid container 18 in the depth direction Y is between the operation panel 14 located at the closed position and the liquid ejecting head 37 and the carriage 38 located at the home position HP. The operation panel 14 located at the closed position, the rear container 18*b*, and the liquid ejecting head 37 and the carriage 38 located at the home position HP are arrayed in the depth direction Y.

The tube 40 has an upstream end joined to the liquid container 18 and a downstream end joined to the liquid relay unit 39. As liquid is supplied from the liquid container 18 to the liquid relay unit 39 via the tube 40, the liquid relay unit 39 feeds the liquid to the liquid ejecting head 37. The liquid ejecting head 37 ejects liquid supplied from the liquid container 18 via the tube 40 and the liquid relay unit 39 to thereby perform recording on the medium 23 or the disk 42.

The recording apparatus 11 may be an apparatus that includes a plurality of liquid containers 18 and a plurality of tubes 40 corresponding to the respective liquid containers 18 to perform color printing by ejecting a plurality of types of liquids. The recording apparatus 11 may also be an apparatus that includes one liquid container 18 and one tube 40 to perform monochrome printing by ejecting one type of liquid. The liquid container 18 may be a cartridge that is detachably attached to the recording apparatus 11, or a tank that can be replenished with liquid.

The tube 40 has a curved portion 46 that is curved, an upstream portion 47 located between the curved portion 46 and the liquid container 18, and a downstream portion 48 located between the curved portion 46 and the liquid relay unit 39. The curved portion 46 is a portion that deforms while the carriage 38 moves between the home position HP and a full position FP indicated by the dot-dot-dashed line in FIG. 4. The upstream portion 47 remains at the same position regardless of movement of the carriage 38, whereas the downstream portion 48 moves along with movement of the carriage 38. The downstream portion 48 is located above the upstream portion 47, and aligned with the upstream portion 47 in the depth direction Y.

The recording apparatus 11 may include a maintenance unit 50 that performs maintenance of the liquid ejecting head 37 located at the home position HP. The recording apparatus 11 includes an accommodating unit 52 configured to accommodate a waste liquid container 51 configured to store waste liquid discharged from the liquid ejecting head 37. The waste liquid container 51 may be detachably accommodated in the accommodating unit 52. The maintenance unit 50 may discharge waste liquid from the nozzles 36 by applying a negative pressure or a positive pressure to the liquid in the liquid ejecting head 37. The waste liquid container 51 communicates with the maintenance unit 50 via a waste liquid flow path (not shown) and stores waste liquid discharged from the maintenance unit 50. The waste liquid container 51 may also store waste liquid ejected from the liquid ejecting head 37 for maintenance.

As shown in FIG. 3, the accommodating unit 52 is located between the front wall 13 and the liquid ejecting head 37 in the depth direction Y, and accommodates the waste liquid container 51 at this position. That is, the waste liquid container 51 accommodated in the accommodating unit 52 is also located between the front wall 13 and the liquid ejecting head 37 in the depth direction Y. The accommodating unit 52 may also be located between the front wall 13 and the carriage 38 in the depth direction Y and above the transport path 26, and accommodate the waste liquid container 51 at this position. The accommodating unit 52 may also be located between the front wall 13 and the tube 40 in the depth direction Y, and accommodate the waste liquid container 51 at this position.

As shown in FIG. 4, the accommodating unit 52 accommodates the waste liquid container 51 with a lower end 51*a* of the waste liquid container 51 being located under a lower end 46*a* of the curved portion 46 and the upstream portion 47. The accommodating unit 52 accommodates the waste liquid container 51 with an upper end 51*b* of the waste liquid container 51 being above an upper end 46*b* of the curved portion 46 and the downstream portion 48. A distance from the downstream portion 48 to the upstream portion 47 and a dimension of the curved portion 46 in the vertical direction Z may be smaller than that of the waste liquid container 51. This reduces a possibility of the tube 40 abutting with the liquid container 18 even when the tube 40 deforms as the carriage 38 moves.

The accommodating unit 52 may be located at a position that does not overlap the liquid container 18 in the width direction X, and accommodate the waste liquid container 51 at this position. The waste liquid container 51 accommodated in the accommodating unit 52 may overlap the liquid container 18 in the depth direction Y and the vertical direction Z.

The accommodating unit 52 may also be located at a position that does not overlap the liquid ejecting head 37 and the carriage 38 in the width direction X while the liquid ejecting head 37 and the carriage 38 are located at the home position HP, and accommodate the waste liquid container 51 at this position. The accommodating unit 52 may also be located above the output tray 32 and the disk tray 43, and accommodate the waste liquid container 51 at this position. The accommodating unit 52 may also be located above the projection 34, and accommodate the waste liquid container 51 at this position.

Figure 5:
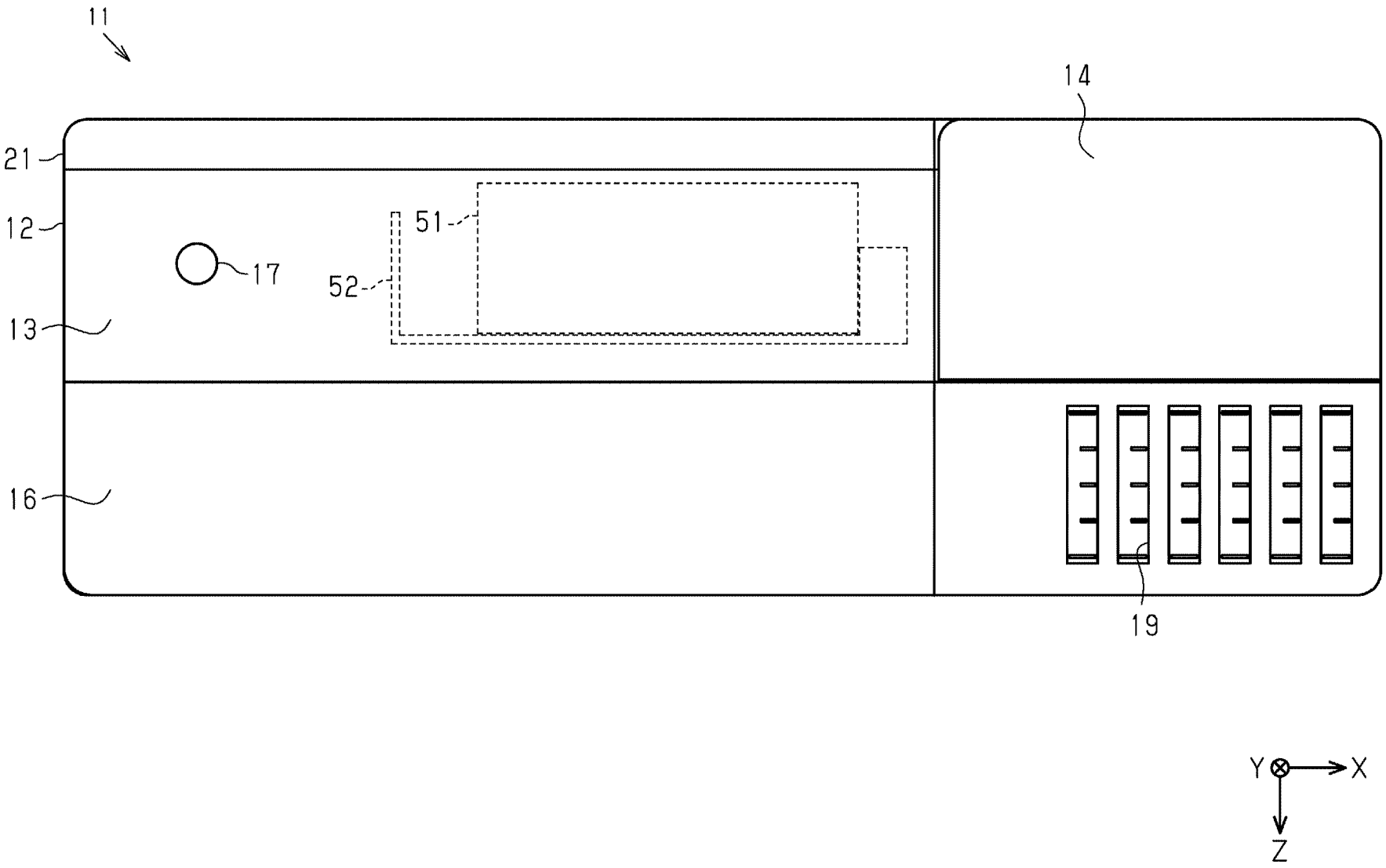
FIG. 5 is a schematic front view of the recording apparatus.

As shown in FIG. 5, the accommodating unit 52 is located at a position that does not overlap the operation panel 14 in the width direction X, and accommodates the waste liquid container 51 at this position. The accommodating unit 52 may also be located at a position that overlaps the operation panel 14 in the depth direction Y, and accommodate the waste liquid container 51 at this position.

Operations of the present embodiment will be described below. As shown in FIG. 2, in maintenance of the liquid container 18, the operator moves the image reading unit 21 and the operation panel 14 to the open position. When the image reading unit 21 and the operation panel 14 are located at the open position, the operator can access the waste liquid container 51 from above.

In replacement of the waste liquid container 51, the operator first moves the waste liquid container 51 along the X axis in a direction away from the home position HP. Thus, the waste liquid container 51 can be pulled out upward. In attachment of the waste liquid container 51, the operator places the waste liquid container 51 on the accommodating unit 52, and moves it along the X axis in a direction approaching the home position HP. Thus, the waste liquid container 51 is accommodated in the accommodating unit 52, and becomes ready to store waste liquid discharged from the liquid ejecting head 37.

Effects of the present embodiment will be described below.

(1) The accommodating unit 52 accommodates the waste liquid container 51 at a position between the front wall 13 and the liquid ejecting head 37 in the depth direction Y. Accordingly, the waste liquid container 51 can be easily accessed for maintenance from the front side of the apparatus main body 12. The accommodating unit 52 accommodates the waste liquid container 51 at a position that does not overlap the operation panel 14 in the width direction X. Accordingly, the apparatus main body 12 can be reduced in size in the depth direction Y compared with a case, for example, where the waste liquid container 51 and the operation panel 14 are arrayed in the depth direction Y. Accordingly, maintenance of the waste liquid container 51 can be facilitated while preventing the apparatus main body from increasing in size.

(2) For example, an external force, when applied to the carriage 38, may affect movement of the carriage 38. In this regard, the accommodating unit 52 accommodates the waste liquid container 51 at a position between the front wall 13 and the carriage 38 in the depth direction Y. Accordingly, when the waste liquid container 51 is accessed for maintenance from the front side of the apparatus main body 12, the possibility that the operator applies an external force to the carriage 38 can be reduced. The accommodating unit 52 accommodates the waste liquid container 51 at a position above the transport path 26. Accordingly, the waste liquid container 51 can be easily accessed for maintenance from above the apparatus main body 12.

(3) For example, an external force, when applied to the tube 40, may affect liquid supply from the liquid container 18 to the liquid relay unit 39. In this regard, the accommodating unit 52 accommodates the waste liquid container 51 at a position between the front wall 13 and the tube 40 in the depth direction Y. Accordingly, when the waste liquid container 51 is accessed for maintenance from above the apparatus main body 12, the possibility that the operator applies an external force to the tube 40 can be reduced. The downstream portion 48 of the tube 40 is located above the upstream portion 47. Accordingly, the apparatus main body 12 can be reduced in size in the depth direction Y compared with a case where the downstream portion 48 and the upstream portion 47 are arrayed in the depth direction Y.

(4) A curved position in the tube 40 varies with movement of the carriage 38. The lower end 51*a* of the waste liquid container 51 accommodated in the accommodating unit 52 is located under the lower end 46*a* of the curved portion 46. Accordingly, the possibility that the tube 40, which deforms with movement of the carriage 38, abuts with the liquid container 51 can be reduced.

(5) The accommodating unit 52 accommodates the waste liquid container 51 at a position that does not overlap the liquid container 18 in the width direction X. Accordingly, the apparatus main body 12 can be reduced in size in the depth direction Y compared with a case, for example, where the waste liquid container 51 and the liquid container 18 are arrayed in the depth direction Y.

(6) For example, when the output tray 32 is smaller in size than the medium 23, a portion of the medium 23 protruding from the output tray 32 may sag down when the medium 23 is supported by the output tray 32, and the medium 23 may fall off from the output tray 32 due to the weight of the medium itself. In this regard, the output tray 32 has the projection 34 that protrudes upward from the support surface 33. That is, the output tray 32 can support the medium 23 while causing the medium 23 to be curved by the support surface 33 and the projection 34. Therefore, the medium 23 can be prevented from sagging down, which reduces the possibility of the medium 23 falling off from the output tray 32. The accommodating unit 52 accommodates the waste liquid container 51 at a position above the projection 34 of the output tray 32. Accordingly, the waste liquid container 51 can be easily accessed for maintenance from above the apparatus main body 12.

(7) The accommodating unit 52 accommodates the waste liquid container 51 at a position above the disk tray 43. Accordingly, the waste liquid container 51 can be easily accessed for maintenance from above the apparatus main body 12.

The present embodiment can be modified and implemented as follows. The present embodiment and the following modifications can be implemented in combination with each other as long as they are not technically inconsistent.

- The accommodating unit 52 may be located at the same position as the disk tray 43 or a position under the disk tray 43 in the vertical direction Z, and accommodate the waste liquid container 51 at this position.
- The accommodating unit 52 may be located at the same position as the projection 34 or a position under the projection 34 in the vertical direction Z, and accommodate the waste liquid container 51 at this position.
- The output tray 32 may include one projection 34. For example, the projection 34 may be located at the center in the width direction X. The output tray 32 may support the medium 23 while causing the medium 23 to be curved with the center being located higher than both ends in the width direction X. The output tray 32 may include three or more projections 34.
- The accommodating unit 52 may be located at a position that overlaps the liquid container 18 in the width direction X, and accommodates the waste liquid container 51 at this position.
- The liquid container 18 may be mounted on the carriage 38. In this case, the recording apparatus 11 may be configured without the tube 40 and the liquid relay unit 39.
- The accommodating unit 52 may accommodate the waste liquid container 51 with the lower end 51*a* of the waste liquid container 51 being at the same position with the lower end 46*a* of the curved portion 46 and the upstream portion 47 or above the lower end 46*a* of the curved portion 46 and the upstream portion 47 in the vertical direction Z.
- The upstream portion 47 and the downstream portion 48 of the tube 40 may be arrayed in the depth direction Y.
- The accommodating unit 52 may be located at a position that overlaps the tube 40 in the depth direction Y, and accommodate the waste liquid container 51 at this position.
- The liquid ejecting head 37 perform recording by ejecting liquid onto the medium 23 while moving relative to the medium 23. The liquid ejecting head 37 may be a line head that is elongated in the width direction of the medium 23. The liquid ejecting head 37 may also be stationary and eject liquid onto the medium 23 or the disk 42 which is being transported. The width direction X of the recording apparatus 11 may be different from the width direction of the medium 23.
- The recording apparatus 11 may be a liquid ejecting apparatus that performs recording by ejecting or discharging liquid other than ink. A state of liquid ejected from the liquid ejection apparatus includes a minute amount of liquid droplets having a granular shape, a tear shape, and an elongated thread-like shape. The liquid as described herein may be any material that can be ejected from the liquid ejecting apparatus. For example, the liquid may be a material in a state of a liquid phase, and includes liquid state materials having high or low viscosity, and liquid state materials such as sol, gel water, other inorganic solvents, organic solvents, solutions, liquid resins, liquid metal, and metal melt. The liquid includes not only liquid as one of the states of substances, but also materials in which particles of a functional material having solids such as pigments and metal particles are dissolved, dispersed, or mixed in a solvent. Typical examples of the liquid include ink described in the above embodiment, liquid crystals, and the like. Here, the ink includes various types of liquid compositions such as general water-based ink, oil-based ink, gel ink and hot melt ink. Specific examples of the liquid ejecting apparatus include apparatuses that eject liquid containing a material such as an electrode material and a color material in a dispersed or dissolved state for use in manufacturing of liquid crystal displays, electroluminescence displays, surface emitting displays, color filters, or the like. The liquid ejecting apparatus may be an apparatus that ejects a bioorganic material used for manufacturing biochips, an apparatus that is used as a precision pipette and ejects liquid as a sample, a textile printing apparatus, a micro dispenser, or the like. The liquid ejecting apparatus may be an apparatus that ejects lubricant in a pinpoint manner to a precision machine such as a watch, a clock, and a camera, or an apparatus that ejects transparent resin liquid such as an ultraviolet curable resin liquid onto a substrate for forming micro hemisphere lenses, optical lenses, or the like that are used for optical communication elements or the like. The liquid ejecting apparatus may be an apparatus that ejects acidic or alkaline etchant for etching a substrate or the like.

The following describes technical ideas and their effects and advantages obtained from the above embodiments and modifications.

(A) A recording apparatus includes an apparatus main body including: a transport unit that transports a medium; a liquid ejecting head that is provided above a transport path for the medium and performs recording by ejecting liquid onto the medium; and an accommodating unit that accommodates a waste liquid container configured to store waste liquid discharged from the liquid ejecting head, wherein a front surface of the apparatus main body is provided with a front wall and an operation panel that can be operate various operations, which are adjacent to each other in a width direction, and the accommodating unit is located between the front wall and the liquid ejecting head in a depth direction at a position that does not overlap the operation panel in the width direction.

With this configuration, the accommodating unit accommodates the waste liquid container at a position between the front wall and the liquid ejecting head in the depth direction. Accordingly, the waste liquid container can be easily accessed for maintenance from the front side of the apparatus main body. The accommodating unit accommodates the waste liquid container at a position that does not overlap the operation panel in the width direction. Accordingly, the apparatus main body can be reduced in size in the depth direction compared with a case, for example, where the waste liquid container and the operation panel are arrayed in the depth direction. Accordingly, maintenance of the waste liquid container can be facilitated while preventing the apparatus main body from increasing in size.

(B) In the recording apparatus, the liquid ejecting head may be mounted on a carriage that is movable in the width direction, and the accommodating unit may be located between the front wall and the carriage in the depth direction at a position above the transport path.

For example, an external force, when applied to the carriage, may affect movement of the carriage. With this configuration, the accommodating unit accommodates the waste liquid container at a position between the front wall and the carriage in the depth direction. Accordingly, when the waste liquid container is accessed for maintenance from the front side of the apparatus main body, the possibility that the operator applies an external force to the carriage can be reduced. The accommodating unit accommodates the waste liquid container at a position above the transport path. Accordingly, the waste liquid container can be easily accessed for maintenance from above the apparatus main body.

(C) The recording apparatus may further includes: a liquid relay unit mounted on the carriage; and a tube that communicates the liquid relay unit with a liquid container, wherein the tube may include a curved portion that is curved, an upstream portion located between the curved portion and the liquid container, and a downstream portion located between the curved portion and the liquid relay unit, the downstream portion being located above the upstream portion, and the accommodating unit may be located between the front wall and the tube in the depth direction.

For example, an external force, when applied to the tube, may affect liquid supply from the liquid container to the liquid relay unit. With this configuration, the accommodating unit accommodates the waste liquid container at a position between the front wall and the tube in the depth direction. Accordingly, when the waste liquid container is accessed for maintenance from above the apparatus main body, the possibility that the operator applies an external force to the tube can be reduced. The downstream portion of the tube is located above the upstream portion. Accordingly, the apparatus main body can be reduced in size in the depth direction compared with a case where the downstream portion and the upstream portion are arrayed in the depth direction.

(D) In the recording apparatus, the accommodating unit may accommodate the waste liquid container with a lower end of the waste liquid container being located under a lower end of the curved portion. A curved position in the tube varies with movement of the carriage. With this configuration, the lower end of the waste liquid container accommodated in the accommodating unit is located under the lower end of the curved portion. Accordingly, the possibility that the tube, which deforms with movement of the carriage, abuts with the liquid container can be reduced.

(E) In the recording apparatus, the accommodating unit may be located at a position that does not overlap the liquid container in the width direction, the liquid container being provided under the operation panel. With this configuration, the accommodating unit accommodates the waste liquid container at a position that does not overlap the liquid container in the width direction. Accordingly, the apparatus main body can be reduced in size in the depth direction compared with a case, for example, where the waste liquid container and the liquid container are arrayed in the depth direction.

(F) The recording apparatus may further includes an output tray that supports the medium outputted from the apparatus main body, wherein the output tray may include a support surface that supports the medium and a projection protruding upward from the support surface to support the medium, and the accommodating unit may be located above the projection.

For example, when the output tray is smaller in size than the medium, a portion of the medium protruding from the output tray may sag down when the medium is supported by the output tray, and the medium may fall off from the output tray due to the weight of the medium itself. With this configuration, the output tray has the projection that protrudes upward from the support surface. That is, the output tray can support the medium while causing the medium to be curved by the support surface and the projection. Therefore, the medium can be prevented from sagging down, which reduces the possibility of the medium falling off from the output tray. The accommodating unit accommodates the waste liquid container at a position above the projection of the output tray. Accordingly, the waste liquid container can be easily accessed for maintenance from above the apparatus main body.

(G) The recording apparatus may further include a disk tray that supports a disk which stores information, wherein the liquid ejecting head may be configured to record onto a label surface of the disk supported by the disk tray, and the accommodating unit may be located above the disk tray.

With this configuration, the accommodating unit accommodates the waste liquid container at a position above the disk tray. Accordingly, the waste liquid container can be easily accessed for maintenance from above the apparatus main body.

What is claimed is:

1. A recording apparatus comprising an apparatus main body including:

a transport unit that transports a medium;

a liquid ejecting head that is provided above a transport path for the medium and performs recording by ejecting liquid onto the medium; and an accommodating unit that accommodates a waste liquid container configured to store waste liquid discharged from the liquid ejecting head, wherein a front surface of the apparatus main body is provided with a front wall and an operation unit that can be used to operate various operations, which are adjacent to each other in a width direction, the accommodating unit is located between the front wall and the liquid ejecting head in a depth direction at a position that does not overlap the operation unit in the width direction, and wherein the liquid ejecting head is mounted on a carriage that is movable in the width direction, and the accommodating unit is located between the front wall and the carriage in the depth direction at a position above the transport path.

2. The recording apparatus according to claim 1, further comprising:

a liquid relay unit mounted on the carriage; and a tube that communicates the liquid relay unit with a liquid container, wherein the accommodating unit is located between the front wall and the tube in the depth direction.

3. The recording apparatus according to claim 2, wherein the tube includes a curved portion that is curved, an upstream portion located between the curved portion and the liquid container, and a downstream portion located between the curved portion and the liquid relay unit, the downstream portion being located above the upstream portion, and the accommodating unit accommodates the waste liquid container with a lower end of the waste liquid container being located under a lower end of the curved portion.

4. A recording apparatus comprising an apparatus main body including:

a transport unit that transports a medium;

a liquid ejecting head that is provided above a transport path for the medium and performs recording by ejecting liquid onto the medium; and an accommodating unit that accommodates a waste liquid container configured to store waste liquid discharged from the liquid ejecting head, wherein a front surface of the apparatus main body is provided with a front wall and an operation unit that can be used to operate various operations, which are adjacent to each other in a width direction, the accommodating unit is located between the front wall and the liquid ejecting head in a depth direction at a position that does not overlap the operation unit in the width direction, and wherein at least part of the accommodating unit is located at a position that does not overlap a liquid container in the width direction, the liquid container being provided under the operation unit.

5. A recording apparatus comprising an apparatus main body including:

a transport unit that transports a medium;

a liquid ejecting head that is provided above a transport path for the medium and performs recording by ejecting liquid onto the medium; and an accommodating unit that accommodates a waste liquid container configured to store waste liquid discharged from the liquid ejecting head, wherein a front surface of the apparatus main body is provided with a front wall and an operation unit that can be used to operate various operations, which are adjacent to each other in a width direction, the accommodating unit is located between the front wall and the liquid ejecting head in a depth direction at a position that does not overlap the operation unit in the width direction, and an output tray that supports the medium outputted from the apparatus main body, wherein the output tray includes a support surface that supports the medium and a projection protruding upward from the support surface to support the medium, and the accommodating unit is located above the projection.

6. The recording apparatus according to claim 1, further comprising a disk tray that supports a disk which stores information, wherein the liquid ejecting head is configured to record onto a label surface of the disk supported by the disk tray, and the accommodating unit is located above the disk tray.

* * * * *